US007712682B2

(12) United States Patent
Joseph et al.

(10) Patent No.: US 7,712,682 B2
(45) Date of Patent: May 11, 2010

(54) SPRAY GUN WITH ROTATABLE RESERVOIR

(75) Inventors: Stephen C. P. Joseph, Woodbury, MN (US); Daniel E. Siltberg, White Bear Township, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 275 days.

(21) Appl. No.: 10/551,093

(22) PCT Filed: Mar. 12, 2004

(86) PCT No.: PCT/US2004/007860

§ 371 (c)(1),
(2), (4) Date: Sep. 29, 2005

(87) PCT Pub. No.: WO2004/094072

PCT Pub. Date: Nov. 4, 2004

(65) Prior Publication Data

US 2006/0261185 A1 Nov. 23, 2006

(30) Foreign Application Priority Data

Apr. 5, 2003 (GB) ..... 0307902.7

(51) Int. Cl.
*A62C 13/62* (2006.01)
*A62C 11/00* (2006.01)

(52) U.S. Cl. ..... 239/302; 239/359; 239/361; 239/600

(58) Field of Classification Search ..... 239/302, 239/344, 354, 361, 398, 451, 457, 600, 587.1, 239/587.2, 587.5, 587.6, DIG. 14, 359, 376; 222/402.1, 402.13, 402.15
See application file for complete search history.

(56) References Cited

U.S. PATENT DOCUMENTS

| | | | | |
|---|---|---|---|---|
| 1,703,384 | A | 2/1929 | Birkenmaier | |
| 1,988,017 | A | 1/1935 | Norwick | |
| 2,051,518 | A | 8/1936 | Cunningham | |
| 2,228,861 | A | 1/1941 | Wegener | |
| 3,227,305 | A | 1/1966 | Enssle | |
| 3,255,972 | A | 6/1966 | Huitgren et al. | |
| 3,773,211 | A | 11/1973 | Bridgman | |
| 3,934,746 | A | 1/1976 | Lilja | |
| 4,035,004 | A * | 7/1977 | Hengesbach | 285/146.1 |
| 4,712,739 | A * | 12/1987 | Bihn | 239/290 |

(Continued)

FOREIGN PATENT DOCUMENTS

| | | |
|---|---|---|
| CA | 2569369 | 7/1998 |

(Continued)

*Primary Examiner*—Davis Hwu
(74) *Attorney, Agent, or Firm*—Steven E. Skolnick

(57) ABSTRACT

A reservoir (402) for connection to a spray gun has a lid (410) provided with an outlet spout (415) that is rotatably received in a socket of an inlet adaptor (419) connectable to the spray gun. The lid (410) has a spring leg (425) spaced from the outlet spout (415) with a projection (426) at the distal end for self-latching engagement with a flange (423) of the adaptor (419) to secure releasably the reservoir (402) to the spray gun. The engagement of the projection (426) and flange (423) enables the reservoir (401) to be rotated through 360° to adjust the position of the reservoir (402) while attached to the spray gun.

9 Claims, 13 Drawing Sheets

U.S. PATENT DOCUMENTS

| | | | | | |
|---|---|---|---|---|---|
| 4,781,311 | A | * | 11/1988 | Dunning et al. | 222/153.09 |
| 4,930,644 | A | | 6/1990 | Robbins, III | |
| 4,946,558 | A | * | 8/1990 | Salmon | 202/167 |
| 4,951,875 | A | | 8/1990 | Devey | |
| 5,069,389 | A | | 12/1991 | Bitsakos | |
| 5,123,571 | A | | 6/1992 | Rebeyrolle et al. | |
| 5,143,294 | A | | 9/1992 | Lintvedt | |
| 5,211,289 | A | | 5/1993 | Matthews | |
| 5,421,489 | A | | 6/1995 | Holzner, Sr. et al. | |
| 5,655,714 | A | | 8/1997 | Kieffer et al. | |
| 5,803,360 | A | | 9/1998 | Spitznagel | |
| 5,875,971 | A | * | 3/1999 | Morck | 239/345 |
| 6,027,041 | A | * | 2/2000 | Evans | 239/334 |
| 6,053,429 | A | | 4/2000 | Chang | |
| 6,092,740 | A | | 7/2000 | Liu | |
| 6,536,684 | B1 | | 3/2003 | Wei | |
| 6,536,687 | B1 | | 3/2003 | Navis et al. | |
| 6,595,441 | B2 | | 7/2003 | Petrie et al. | |
| 6,820,824 | B1 | | 11/2004 | Joseph et al. | |
| 7,188,785 | B2 | | 3/2007 | Joseph et al. | |

FOREIGN PATENT DOCUMENTS

| | | | |
|---|---|---|---|
| DE | 209147 | | 2/1907 |
| DE | 210449 | | 5/1909 |
| FR | 2 784 314 | A1 | 4/2000 |
| WO | WO 98/32539 | | 7/1998 |
| WO | WO 01/12337 | A1 | 2/2001 |
| WO | WO 02/085533 | A1 | 10/2002 |

* cited by examiner

SPRAY GUN WITH ROTATABLE RESERVOIR

FIELD OF THE INVENTION

This invention concerns improvements in liquid spraying apparatus such as a spray gun. More especially, it relates to the connection between the spray gun and a reservoir containing the liquid to be sprayed. The invention has particular application to a releasable connection for detachably mounting the reservoir on the spray gun.

BACKGROUND OF THE INVENTION

Spray guns are widely used in vehicle body repair shops when re-spraying a vehicle that has been repaired following an accident. In the known spray guns, the liquid is contained in a reservoir attached to the gun from where it is fed to a spray nozzle. On emerging from the spray nozzle, the liquid is atomised and forms a spray with compressed air supplied to the nozzle. The liquid may be gravity fed or suction fed or, more recently, pressure fed by an air bleed line to the reservoir from the compressed air line to the spray gun.

Traditionally, the liquid is contained in a rigid pot mounted on the spray gun by engagement of complementary screw threads on the pot and gun. In this way, the pot can be removed for cleaning or replacement. Typically, the pot is secured to the gun empty and has a removable lid by means of which the liquid can be added to the pot while attached to the gun. On completion of spraying, the pot can be removed and the gun and pot cleaned for re-use.

Such screw threaded connection requires the reservoir to be rotated several times, typically at least four or five turns, to engage fully the threads and secure the reservoir in a fluid tight manner. This is time consuming and requires considerable care and dexterity on the part of the user.

Furthermore, the threads on the gun and pot may be damaged by mis-use, for example if an attempt is made to secure a pot having a non-matching thread. Also, on completion of spraying, careful cleaning is required to remove all traces of liquid from the threads to prevent the threads becoming blocked, for example with dried paint, and to prevent cross-contamination with the liquid next sprayed.

Damaged or blocked threads may render the gun unusable requiring the purchase of a new gun. This adds to costs and is inconvenient if time is lost because a spare gun is not to hand to continue spraying. Moreover, cleaning of the threads usually requires solvents that are also used to clean the gun and pot. The use of solvents is undesirable from health and safety considerations and causes problems for disposal of the solvent after use.

These problems can be reduced by employing a bayonet type connection to secure releasably the reservoir to the spray gun by engagement of bayonet type formations on the reservoir and spray gun with a push-twist action requiring less than one complete turn of the reservoir to connect/disconnect the reservoir. Examples of bayonet type formations that can be used to provide a releasable quick-fit connection of this type are disclosed in International Patent Applications No. WO 98/32539 and WO 01/12337 the disclosures of which are incorporated herein.

The mounted position of the reservoir is fixed by the use of screw threads or bayonet formations to secure the reservoir to the spray gun and adjustments to the mounted position cannot be made with the reservoir attached to the spray gun. Typically, the reservoir has an outlet located at one end on the central longitudinal axis of the reservoir and the spray gun has an inlet at the top (gravity feed) or bottom (suction feed) that is located on the central longitudinal axis of the gun.

A system has been developed that allows the reservoir to be re-filled while attached to the spray gun by means of an inlet located at the end of the reservoir adjacent to the outlet as described in International Patent Application No. WO 02/085533 the disclosure of which is also incorporated herein. With this system, access to the inlet when the reservoir is connected to the spray gun may be improved by arranging the outlet from the reservoir to be offset from the central longitudinal axis of the reservoir.

Such offset arrangement of the outlet can, however, result in the reservoir extending to one side of the spray gun when the outlet is connected to the inlet on the spray gun by engagement of screw threads or bayonet formations to secure releasably the reservoir.

Also, in a gravity feed arrangement, the reservoir is connected to an inlet on the top of the spray gun and the offset arrangement of the outlet may position the outlet above the level of liquid in the reservoir when the spray gun is used at different angles, especially when the liquid level reduces. This can have an adverse effect on flow of paint to the outlet especially when a small volume of paint remains in the reservoir. As a result, the spray gun may have to be maneuvered and held in a position that is uncomfortable for the user in order to dispense the final volume of paint.

SUMMARY OF THE INVENTION

The present invention has been made from a consideration of the foregoing problems and disadvantages of the existing methods for securing a reservoir to a spray gun.

More particularly, embodiments of the present invention provide an improved releasable connection between the gun and reservoir that enables the reservoir to be attached to and detached from the gun in a simple manner.

Furthermore, at least some embodiments of the present invention provide an improved connection between a spray gun and reservoir such that the mounted position of the reservoir can be adjusted relative to the spray gun while the reservoir is attached to the spray gun.

Moreover, at least some embodiments of the present invention provide such improved connection between the gun and reservoir that does not require a high degree of dexterity on the part of the user to adjust the mounted position of the reservoir and/or to connect/disconnect the reservoir.

Additionally, at least some embodiments of the present invention provide such improved connection between the gun and reservoir such that the reservoir can be connected to and disconnected from the spray gun by axial movement only relative to the spray gun.

Thus, according to one aspect of the present invention, there is provided liquid spraying apparatus comprising a spray gun having an inlet, a reservoir for a liquid to be sprayed, connector means connecting an outlet from the reservoir to the inlet of the spray gun to permit the liquid to be withdrawn from the reservoir in use, the connector means being releasable for detaching the outlet from the inlet, and permitting rotation of the outlet relative to the inlet while the reservoir is attached to the spray gun without compromising the integrity of the connection between the reservoir and the spray gun By this invention, the integrity of the connection between the reservoir and spray gun is maintained while permitting rotation of the outlet of the reservoir relative to the inlet of the spray gun. In this way, the mounted position of the reservoir can be adjusted while attached to the spray gun to provide optimum balance and handling of spray gun for all spray positions and conditions. Furthermore, adjusting the mounted position of the reservoir while attached to the spray gun may allow the outlet from the reservoir to be positioned at the lowest point to ensure that all the liquid can be withdrawn from the reservoir in use.

As used herein, the term "liquid" refers to all forms of flowable materials that can be applied to a surface using a spray gun (whether or not they are intended to colour the surface) including (without limitation) paints, primers, base coats, lacquers, varnishes and similar paint-like materials as well as other materials such as adhesives, sealers, fillers, putties, powder coatings, blasting powders, abrasive slurries, mould release agents and foundry dressings which may be applied in atomised or non-atomised form depending on the properties and/or the intended application of the material and the term "liquid" is to be construed accordingly.

Preferably, the connector means permits rotation of the reservoir outlet through at least 90°, preferably at least 180° and more preferably at least 360° relative to the spray gun inlet with the outlet of the reservoir in communication with the inlet of the spray gun.

Advantageously, the connector means comprises at least one resilient clip on one of the reservoir and spray gun engageable with an abutment on the other of the reservoir and spray gun to resist axial separation of the reservoir and spray gun while permitting rotation of the reservoir outlet relative to the spray gun inlet.

In a preferred arrangement, the reservoir outlet and spray gun inlet are connectable by push fit and the resilient clip comprises a spring leg arranged to extend substantially parallel to the direction of movement of the reservoir outlet towards/away from the spray gun inlet and the abutment comprises a ledge transverse to said direction of movement. In this way, the spring leg engages behind the ledge when the reservoir outlet is connected to the spray gun inlet and can rotate relative to the ledge while resisting axial separation of the reservoir outlet from the spray gun inlet.

Preferably, one of the spring leg and ledge has a cam face arranged to deflect the spring leg when the reservoir outlet is connected to the spray gun inlet to allow a distal end of the spring leg to pass the ledge and latch behind the ledge to secure releasably the reservoir to the spray gun. In this way, the spring leg and ledge are engageable automatically to secure the reservoir to the spray gun.

Advantageously, the distal end of the spring leg has an undercut retainer face arranged to latch behind the ledge and the spring leg is manually deflectable to position the retainer face clear of the ledge to release the reservoir and allow the reservoir outlet to be disconnected from the spray gun inlet. In this way, the reservoir outlet is connected to and disconnected from the spray gun inlet by axial movement only between the reservoir and spray gun.

Preferably, the cam face and retainer face are provided by a projection that extends outwards from the distal end of the spring leg towards the reservoir outlet and has a transverse width greater than the spring leg. In this way, the contact surface area of the retainer face with the ledge is increased. As a result, the retention of the reservoir by engagement of the retainer face with the ledge may be enhanced without any adverse affect on the ability of the spring leg to deflect resiliently to secure/release the reservoir. Furthermore, the increased width of the projection may allow the projection to bridge any circumferential discontinuities in the ledge such that engagement with the ledge to secure the reservoir is maintained.

Advantageously, the projection is of generally triangular shape and the distal end of the spring leg is connected to an apex of the triangular projection. In this way, the projection extends in the direction of rotation of the reservoir to either side of the spring leg and forces transmitted to the spring leg through engagement of the projection with the ledge are balanced.

The spring leg may be provided on the spray gun (or an inlet adaptor secured to the spray gun) and the ledge on the reservoir. More preferably, however, the spring leg is provided on the reservoir and the ledge on the spray gun (or an inlet adaptor secured to the spray gun).

In a preferred arrangement, the reservoir outlet is provided by a tubular spout extending from a lid at one end of the reservoir, and the spray gun inlet is provided by a socket in the body of the spray gun (or an inlet adaptor secured to the spray gun). Preferably, the socket is arranged to receive the spout in a fluid-tight manner. For example, the spout may be provided with one or more annular seal formations providing a fluid-tight seal with the opposed wall of the socket.

Preferably, the spring leg is spaced from and extends substantially parallel to the spout and the ledge is provided by an external flange on the body of the spray gun (or an inlet adaptor secured to the spray gun). In this way, the secured position of the reservoir can be adjusted by rotational movement of the spout relative to the socket without compromising the fluid connection between the spout and the socket.

The spout may be aligned with a central longitudinal axis of the reservoir. Alternatively, the spout may be offset relative to the central longitudinal axis of the reservoir. The reservoir may be provided with an inlet in the lid separate from the spout through which liquid can be added to the reservoir when the reservoir is connected to the spray gun. The inlet may be provided with a removable closure cap for opening/closing the inlet.

The reservoir may be re-usable. For example, the lid may be attached to a rigid container that is removed from the spray gun and cleaned on completion of spraying. The amount of cleaning required may be reduced by containing the liquid in a disposable lid/liner assembly within an outer container of the type disclosed in International Patent Application No. WO 98/32539. Alternatively, a disposable reservoir may be employed that can be removed and thrown away after use.

According to another aspect of the present invention, there is provided liquid spraying apparatus comprising a spray gun having an inlet, a reservoir for a liquid to be sprayed, the reservoir having an outlet connectable to the inlet of the spray gun to permit the liquid to be withdrawn from the reservoir in use, the inlet and outlet defining a connection axis when engaged, and retainer means operable in response to connection of the reservoir outlet and spray gun inlet to permit rotation of the reservoir outlet relative to the spray gun inlet about the connection axis and to resist separation of the reservoir outlet and spray gun inlet in a direction parallel to the connection axis in all angular adjusted positions of the reservoir relative to the spray gun.

Preferably, the retainer means is self-latching in response to connection of the reservoir outlet and spray gun inlet to secure the reservoir to the spray gun and is manually releasable when it is desired to disconnect the reservoir outlet from the spray gun inlet.

The retainer means may permit unrestricted rotation of the reservoir relative to the spray gun through 360° about the connection axis. In this way, the reservoir may be rotated to any angular adjusted position after connection of the outlet to the spray gun inlet and the retainer means is operable to resist removal of the reservoir in all angular adjusted positions.

According to yet another aspect of the invention there is provided a reservoir for use with a spray gun, the reservoir having an outlet for connection to an inlet on the spray gun and a resilient retainer clip for self-latching engagement with the spray gun to secure the reservoir to the spray gun, the arrangement being such that the reservoir outlet can be rotated relative to the spray gun inlet while the reservoir is connected to the spray gun and the retainer clip is operable to secure the reservoir in all rotationally adjusted positions of the outlet.

Preferably, the outlet is provided at an end of the reservoir and the reservoir has an inlet separate from the outlet at the same end such that liquid can be added to the reservoir while the outlet is connected to the spray gun.

Advantageously, the outlet is offset relative to a central longitudinal axis of the reservoir and the reservoir can be rotated while connected to the spray gun to align the central longitudinal axis with a central longitudinal axis of the reservoir. Alternatively or additionally, the reservoir can be rotated to position the outlet at the lowest point of the reservoir to allow substantially all of the liquid to be withdrawn from the reservoir in use. The reservoir may also be rotatable to facilitate access to an inlet where provided for adding liquid to the reservoir while connected to the spray gun.

According to yet another aspect of the present invention, there is provided a connector system for securing a reservoir to a spray gun, the system comprising a resilient retainer on one of the reservoir and spray gun, and an abutment on the other of the reservoir and spray gun, the retainer being engageable with the abutment when an outlet of the reservoir is connected to an inlet of the spray gun to prevent separation of the reservoir and spray gun while permitting rotation of the reservoir relative to the spray gun.

DETAILED DESCRIPTION OF THE EXEMPLARY EMBODIMENTS

Figure 1:
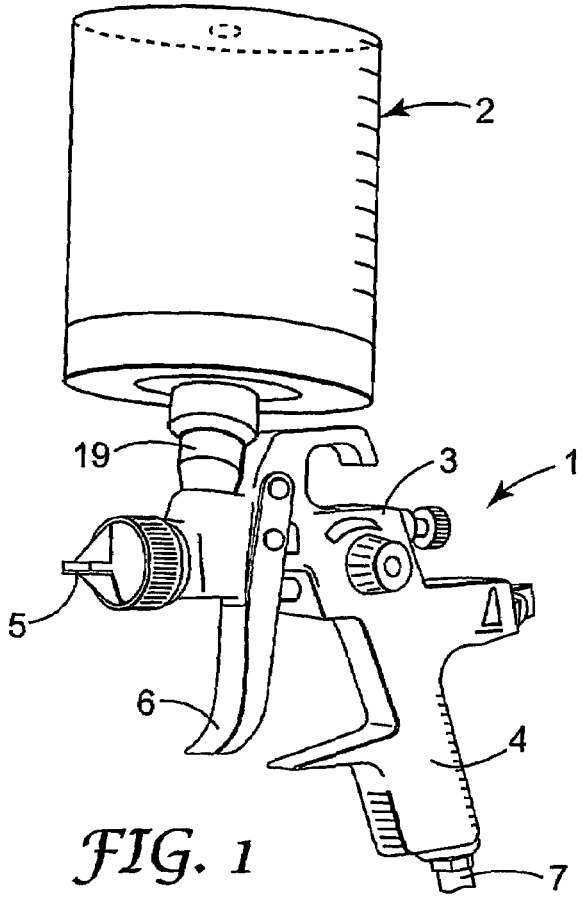
FIG. 1 is a perspective view of liquid spraying apparatus comprising a gravity feed spray gun and reservoir according to the prior art.
Figure 2:
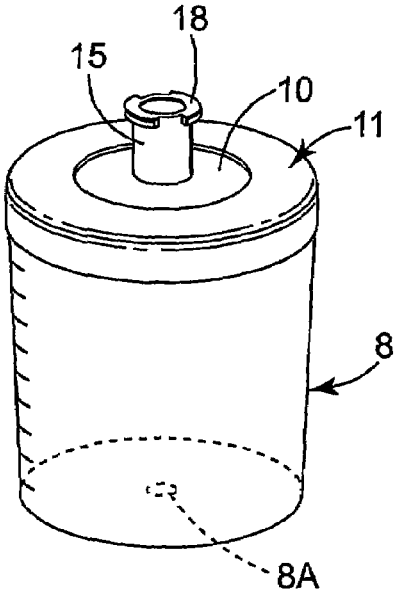
FIG. 2 is a perspective view of the reservoir shown in FIG. 1 separate from the spray gun.
Figure 3:
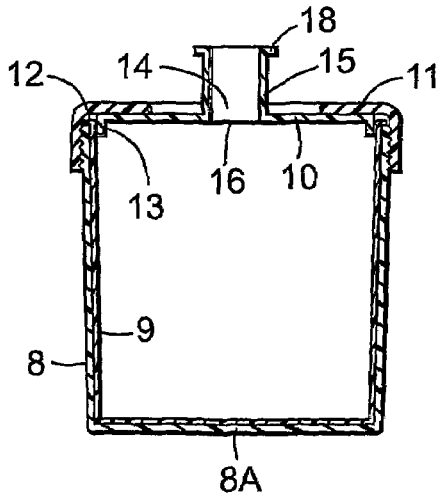
FIG. 3 is a longitudinal section through the reservoir shown in FIG. 2.

Referring first to FIGS. 1 to 3 of the accompanying drawings, there is shown a liquid spraying apparatus of the type disclosed in International Patent Application No. WO 98/32539 comprising a gravity feed spray gun 1 and a reservoir 2 releasably secured to the spray gun 1.

The gun 1 comprises a body 3, a handle 4 which extends downwards from the rear end of the body, and a spray nozzle 5 at the front end of the body. The gun 1 is manually-operated by a trigger 6 which is pivotally-mounted on the sides of the gun.

In use, the gun 1 is connected via a connector 7 at the lower end of the handle 3 to a source of compressed air (not shown) and the reservoir 2 contains paint or other liquid to be sprayed. Compressed air is delivered through the gun 1 to the nozzle when the user pulls on the trigger 6 and paint is delivered under gravity from the reservoir 2 through the gun 1 to the nozzle 5. As a result, the paint is atomised on leaving the nozzle 5 to form a spray with the compressed air emerging from the nozzle 5.

As best shown in FIGS. 2 and 3 of the drawings, the reservoir 2 includes an outer container 8, a disposable liner 9, a disposable lid 10 and a collar 11. The liner 9 corresponds in shape to (and is a close fit in) the interior of the container 8 and has a narrow rim 12 at the open end which sits on the top edge of the container 8.

The lid 10 is of conical shape and has a dependent skirt 13 inset from the peripheral edge. The skirt 13 is a push-fit in the open end of the liner 9 to locate the peripheral edge of the lid 10 over the rim 12 of the liner 9. The lid/liner assembly is secured in place by the annular collar 11 that screws onto the container 8 on top of the lid 10.

The lid 10 has a central aperture 14 that leads to a spout 15 providing a fluid outlet and a mesh filter 16 is arranged to remove particulate material from paint delivered through the tube 15 to the spray gun 1 in use. In this embodiment, the filter 16 is a push fit in the skirt 13 but it will be understood this is not essential and the filter 16 may be a push-fit in the tube 15 or may be an integral part of the lid 10. For some applications, the filter 16 may not be required and can be omitted.

The distal end of the spout 15 is provided with a pair of opposed outwardly directed bayonet lugs 18. The spray gun 1 has a tapped hole (not shown) in the top of the body 3 in which a threaded end of an inlet adaptor 19 is received. The other end of the adaptor 19 is provided with a socket (not shown) in which the spout 15 is received and secured by engagement of the bayonet lugs 18 with bayonet grooves (not shown) in the internal wall of the socket.

The bayonet formations on the spout 15 and socket of the inlet adaptor 19 are engageable with a push twist action that secure the reservoir 2 in a fixed position relative to the gun body 3. In this embodiment, the spout 15 is aligned on the central longitudinal axis of the reservoir 2 and the socket in the adaptor 19 is aligned with the central longitudinal axis of the spray gun 1. As a result, when the reservoir 2 is connected to the spray gun 1, the central longitudinal axes of the reservoir 2 and spray gun 1 lie substantially in the same vertical plane when the reservoir is upright and the reservoir 2 is not offset to one side of the spray gun 1. In this way, balance and handling of the spray gun 1 are optimised.

In use, the liner 9 collapses in an axial direction towards the lid 10 as paint is withdrawn from the reservoir 2. A vent hole 8A in the base of the outer container 8 allows air to enter as the liner 9 collapses. On completion of spraying, the reservoir 2 can be detached from the spray gun 1, the collar 11 released and the lid/liner assembly removed from the outer container 8 in one piece. The outer container 8 and collar 11 are left clean and ready for re-use with a fresh liner 9 and lid 10. In this way, extensive cleaning of the reservoir 2 may be avoided.

The lid/liner assembly may be used to store any paint remaining for a short period of time and re-assembled with the container 8 and collar 11 for attachment to the spray gun 1 to use the remaining paint. Alternatively, the lid/liner assembly can be thrown away when all the paint has been used or is no longer required.

Figure 4:
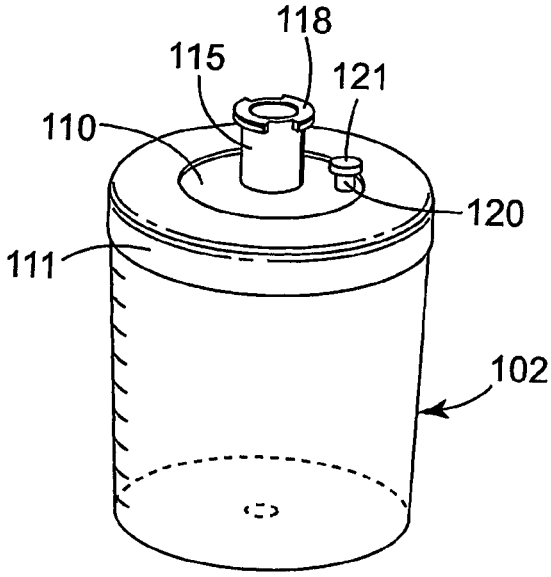
FIG. 4 is a perspective view showing a modified reservoir according to the prior art.
Figure 5:
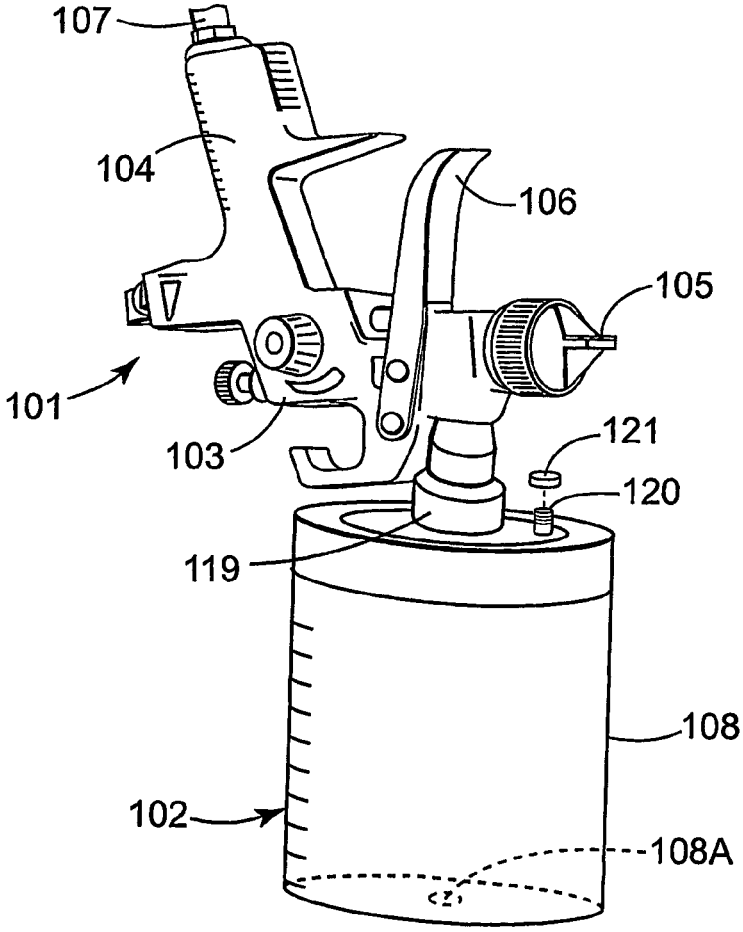
FIG. 5 is a perspective view showing the reservoir of FIG. 4 attached to a spray gun, the gun being shown inverted and the reservoir inlet open.

Referring now to FIGS. 4 and 5, there is shown a modification to the reservoir of FIGS. 1 to 3 by means of which the reservoir can be filled while attached to the spray gun as described in International Patent Application No. WO 02/085533. For convenience, like reference numerals in the series 100 are used to indicate parts corresponding to FIGS. 1 to 3.

As shown the lid 110 of the reservoir 102 has an inlet 120 separate from the spout 115. The inlet 120 is provided with a detachable closure cap 121 that can be removed when the spray gun 101 is inverted as shown in FIG. 5 to allow paint to be added to the reservoir 102 while attached to the spray gun 101.

The reservoir 102 is again secured by engagement of bayonet lugs 118 with bayonet grooves (not shown) in a socket (not shown) of an inlet adaptor 119 secured to the spray gun 101. The mounted position of the reservoir 102 is fixed by the engaged position of the bayonet lugs 118 and grooves which in turn depend on the screw threaded engagement of the inlet adaptor 119 with the spray gun 101.

As a result, when the reservoir 102 is attached to the spray gun 101, it can happen that the spray gun body 103 restricts access to the inlet 120. If this happens, the mounted position of the reservoir 102 cannot be adjusted to improve access to the inlet 120 without compromising the connection between the reservoir 102 and the spray gun 101 and the integrity of the fluid seal between the spout 115 and the inlet adaptor 119.

Thus, the reservoir 102 can only be rotated in a direction to release the bayonet lugs 118 from the bayonet grooves of the socket in the inlet adaptor 119 such that the reservoir 102 would become detached from the inverted spray gun 101.

Figure 6:
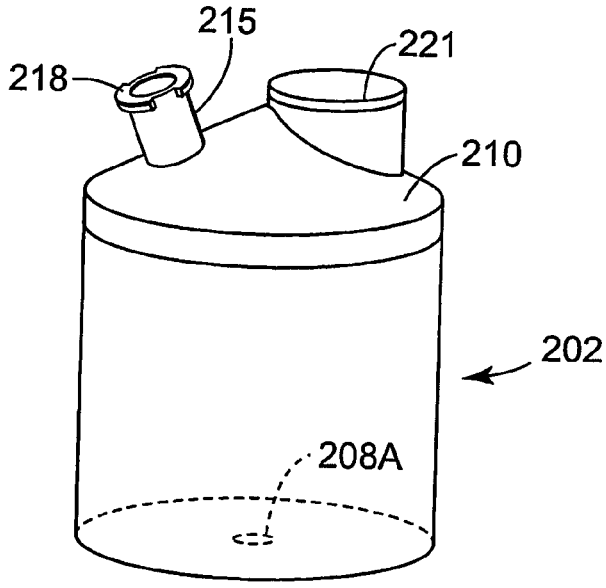
FIG. 6 is a perspective view showing another modified reservoir according to the prior art.
Figure 7:
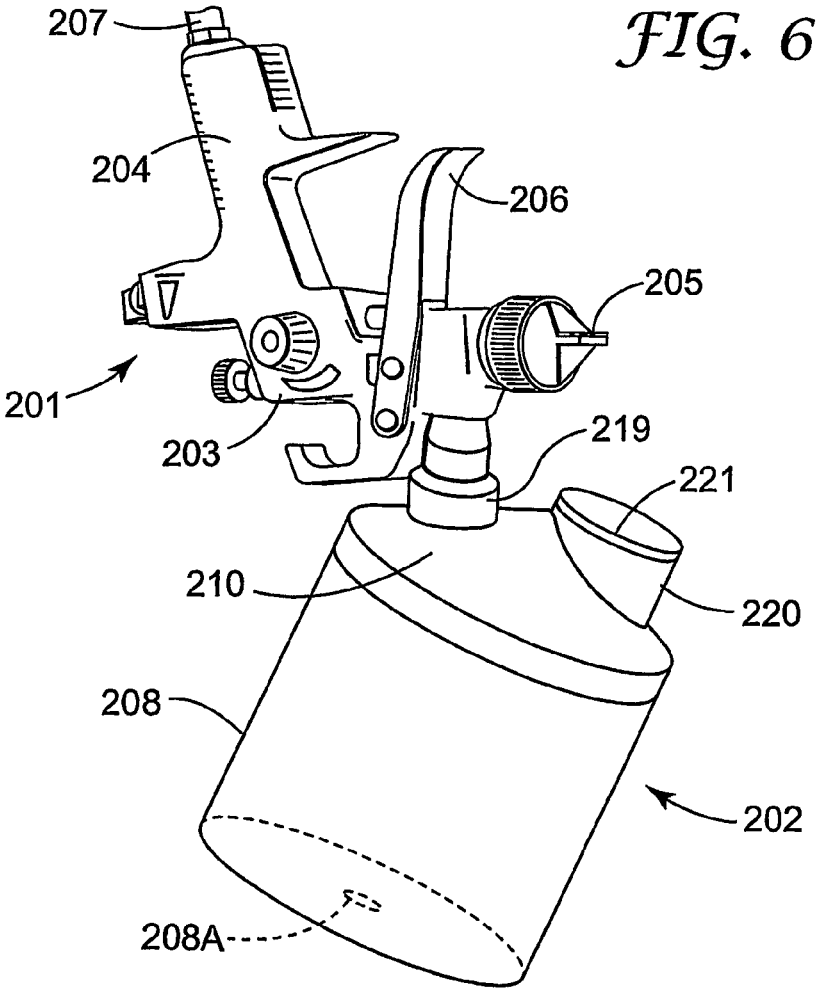
FIG. 7 is a perspective view showing the reservoir of FIG. 6 attached to a spray gun, the spray gun being shown inverted to illustrate access to the reservoir inlet.

Referring now to FIGS. 6 and 7, there is shown a modification to the reservoir of FIGS. 4 and 5 whereby access to the inlet may be improved when the reservoir is attached to the spray gun. For convenience, like reference numerals in the series 200 are used to indicate parts corresponding to FIGS. 4 and 5.

As shown the lid 210 of the reservoir 202 has an outlet spout 215 and a separate inlet 220 with a detachable closure cap 221. In this embodiment, the lid 210 is of frusto-conical shape and the outlet spout 215 is offset from and extends at an angle to the central longitudinal axis of the reservoir 202.

In this way, the inlet 220 may be made larger and, when the reservoir 202 is connected to the spray gun 201, access to the inlet 220 is facilitated making the addition of paint to the reservoir 202 while attached to the spray gun 201 easier.

The reservoir 202 is again secured by engagement of bayonet lugs 218 with bayonet grooves (not shown) in a socket (not shown) of an inlet adaptor 219 secured to the spray gun 201. The mounted position of the reservoir 202 is fixed by the engaged position of the bayonet lugs 218 and grooves which in turn depend on the screw threaded engagement of the inlet adaptor 219 with the spray gun 201.

As a result, when the reservoir 202 is attached to the spray gun 201, it can happen that the offset arrangement of the outlet spout 215 causes the alignment of the central longitudinal axes of the reservoir 202 and spray gun 201 to be lost. As a result, the reservoir 202 may be offset and extend to one side of the spray gun body 203 which can have an adverse effect on balance and handling of the spray gun 201.

Furthermore, depending on the way in which the reservoir 202 is presented to the inlet adaptor 219, the reservoir 202 can be secured in one of two positions according to user preference such that the outlet spout 215 is above or below the inlet 220. Where the spout 215 is above the inlet 220, a dead space is created in the reservoir 202 where paint may become trapped making it difficult to maneuver the spray gun 201 during use to remove all of the paint from the reservoir 202.

If this happens, the mounted position of the reservoir 202 cannot be adjusted to re-position the spout 215 without compromising the connection between the reservoir 202 and the spray gun 201 and the integrity of the fluid seal between the spout 215 and the inlet adaptor 219. As a result, paint may be left in the reservoir 202 which is wasteful and causes problems for safe disposal of the reservoir 202.

Figure 8:
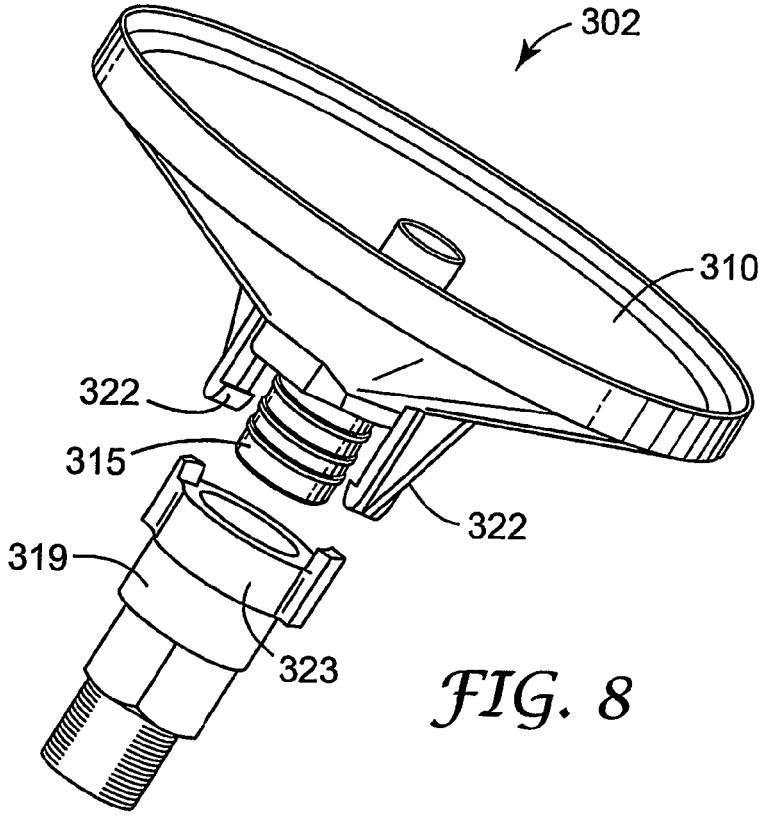
FIG. 8 is an exploded perspective view of an alternative bayonet connection system for a reservoir according to the prior art.
Figure 9:
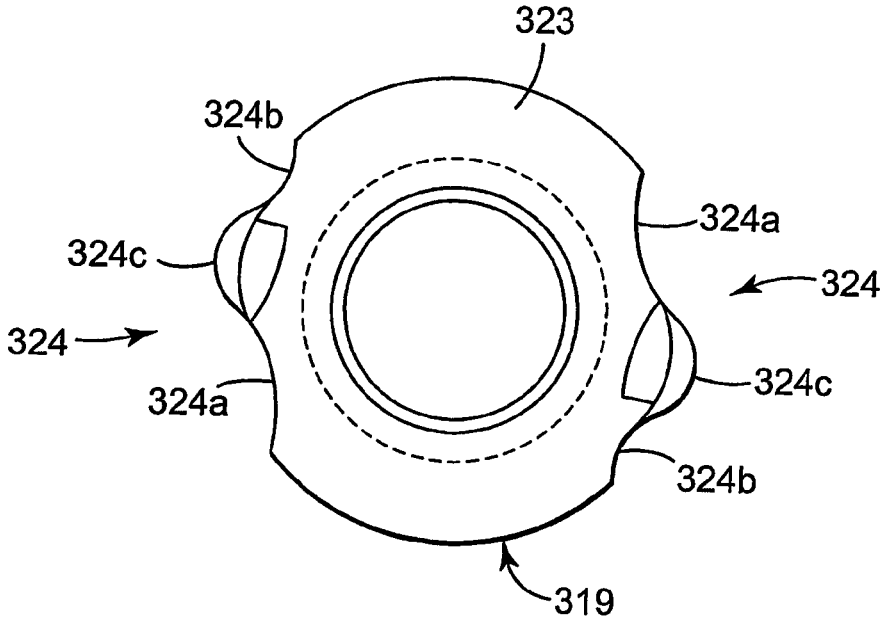
FIG. 9 is an end view of the adaptor shown in FIG. 8.

Referring now to FIGS. 8 and 9, there is shown an alternative bayonet type connection of the type disclosed in International Patent Application No. WO 01/12237 that can be used to secure the reservoir to the spray gun. For convenience like reference numerals in the series 300 are used to indicate parts corresponding to the previous embodiments.

As shown, the bayonet connection is provided by engagement of a pair of hook members 322 on the lid 310 of the reservoir 302 with an external flange 323 on the inlet adaptor 319.

The flange 323 is formed with a pair of circumferentially spaced recessed portions 324. Each recessed portion 324 comprises a major recess 324*a* and a minor recess 324*b* separated by a lobe 324*c*.

The major recesses 324*a* are sized to allow the hook members 322 on the lid 310 to pass freely when the spout 315 is inserted in the socket of the adaptor 319. Thereafter the reservoir 302 is rotated to position the hook members 322 in the minor recesses 324*b* and locate the hook members 322 over the flange 323 to secure the reservoir 302.

The mounted position of the reservoir 302 is fixed by location of the hook members 322 in the minor recesses 324*b* and the spout 315 of the reservoir 302 cannot be freely rotated in the socket of the adaptor 319.

Figure 10:
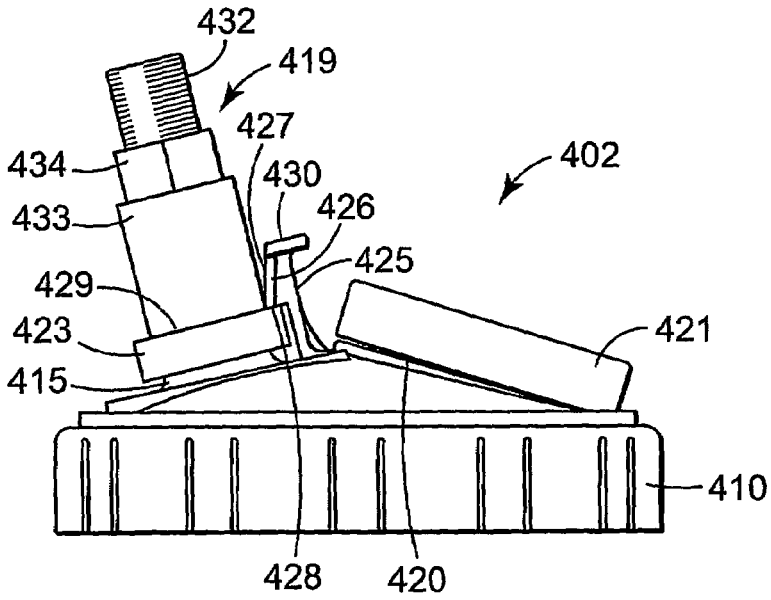
FIG. 10 is a side view of a fully rotatable connection system for a reservoir according to a first embodiment of the present invention.
Figure 11:
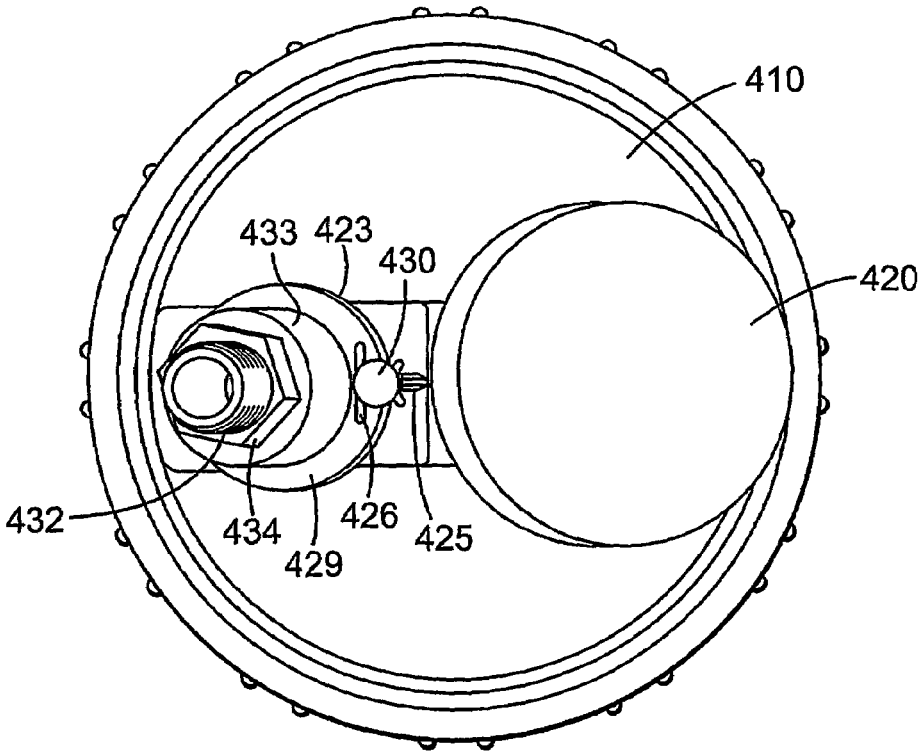
FIG. 11 is a plan view of the fully rotatable connection system shown in FIG. 10.
Figure 12:
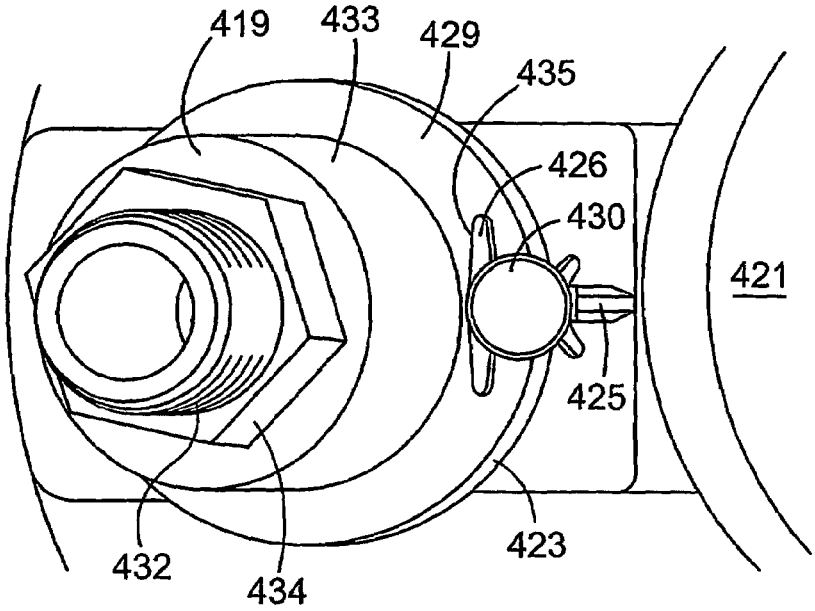
FIG. 12 is a plan view, to an enlarged scale, of the connection system shown in FIG. 11.

Referring now to FIGS. 10, 11 and 12, there is shown a first embodiment of a releasable connector system for securing a reservoir to a spray gun according to the present invention. For convenience, like reference numerals in the series 400 are used to indicate parts corresponding to FIGS. 1 to 9.

As shown, the lid 410 of the reservoir 402 is provided with an outlet spout 415 and a separate inlet 420 having a detachable closure cap 421. The lid 410 is of frusto-conical shape with the spout 415 being offset from and inclined relative to the central longitudinal axis of the reservoir 402 allowing the size of the inlet 420 to be increased.

The spout 415 is cylindrical and is a push fit in a mating cylindrical socket (not shown) in the inlet adaptor 419. The spout 415 may be provided with sealing means such as O-rings (not shown) or ribs (not shown) to provide a fluid tight seal with the opposed wall of the socket while permitting rotation of the spout 415 in the socket as described below.

The connector system for securing the lid 410 to the spray gun (not shown) comprises an integral spring leg 425 on the lid 410 and an annular flange 423 on the adaptor 419.

As shown in FIG. 10, the spring leg 425 extends substantially parallel to and is radially spaced from the spout 415. The distal end of the spring leg 425 has a lateral projection 426 with a chamfer face 427 leading to an undercut retainer face 428 to one side of the leg 425. In this embodiment, the spring leg 425 is positioned between the spout 415 and the inlet 420 but it will be understood that this is not essential and the spring leg 425 may be located at any position around the spout 415.

In use, the chamfer face 427 is co-operable with the flange 423 of the adaptor 419 as the spout 415 is inserted in the socket of the adaptor 419 to deflect the distal end of the spring leg 425 outwards until the projection 426 passes the flange 423. The spring leg 425 then returns to its original position due to its inherent resilience causing the projection 426 to locate behind the flange 423. As a result, axial separation of the spout 415 from the socket in the adaptor 419 is prevented by engagement of the retainer face 428 of the projection 426 with the opposed face 429 of the flange 423.

As shown in FIG. 12, the projection 426 is of generally triangular shape being wider at the end arranged to overlie the opposed face 429 of the flange 423. In this way, the surface area of the retainer face 428 engageable with the opposed face 429 of the flange 423 is enhanced and effectively resists release of the reservoir 402 if an axial force is applied to withdraw the spout 415 from the socket of the adaptor 419.

The distal end of the spring leg 425 is also provided with a manually operable actuator in the form of an annular release button 430 that extends outwards from the other side of the spring leg 425 away from the narrow end of projection 426.

In use, the spring leg 425 can be deflected to move the projection 426 clear of the flange 423 by finger pressure applied to the actuator button 430. The spout 415 can then be withdrawn axially from the socket in the adaptor 419 to disconnect the reservoir 402 from the spray gun (not shown).

As shown in FIG. 10, the flange 423 is provided at one end of the adaptor 419 and the other end has an external screw thread 432 for securing the adaptor 419 to the spray gun (not shown). Between the flange 423 and the screw thread 432, the adaptor 419 has a cylindrical portion 433 and a hexagonal portion 434. The adaptor 419 may be rotated by engaging the hexagonal portion 434 with a spanner or the like (not shown) to connect or disconnect the adaptor 419. In a modification (not shown) the inlet adaptor 419 may be permanently secured to or formed integrally with the spray gun body (not shown).

As shown in FIG. 12, the projection 426 terminates at an outer edge 435 that extends substantially tangential to the cylindrical portion 433 of the adaptor 419. In this way, the projection 426 rotates around the cylindrical portion 433 and maintains engagement with the flange 423 if the spout 415 is rotated in the socket of the adaptor 419. As a result, the position of the reservoir 402 relative to the spray gun (not shown) can be adjusted without releasing the reservoir 402.

In this way, the reservoir 402 can be rotated through 360° relative to the spray gun (not shown) to position the centre of gravity of the reservoir 402 to optimise balance and handling while spraying. For example, the central longitudinal axes of the reservoir 402 and spray gun (not shown) may be arranged in substantially the same vertical plane when the spray gun is used in an upright position. Alternatively, the central longitudinal axis of the reservoir 402 may be offset to one side of the central longitudinal axis of the spray gun if the spray gun is used at an angle or if space is restricted.

Furthermore, during spraying the reservoir 402 can be rotated to position the spout 415 at the lowest point to prevent a dead space occurring in the reservoir 402 where paint may be trapped. Moreover, when it is desired to add paint to the reservoir through the inlet 420, the reservoir 402 can be rotated to a position in which access to the inlet 420 is facilitated.

As will be appreciated, the lid 410 may be provided with more than one spring leg 425 arranged to engage the flange 423 on the adaptor 419 to secure releasably the reservoir 402 to the spray gun (not shown) while permitting rotation of the reservoir 402 relative to the spray gun. Furthermore, it will be appreciated that flange 423 does not require any recesses to engage/disengage the spring leg 425. The flange 423 can therefore be of a uniform, annular shape that is simpler to manufacture than the flange shown in FIGS. 8 and 9.

Figure 13:
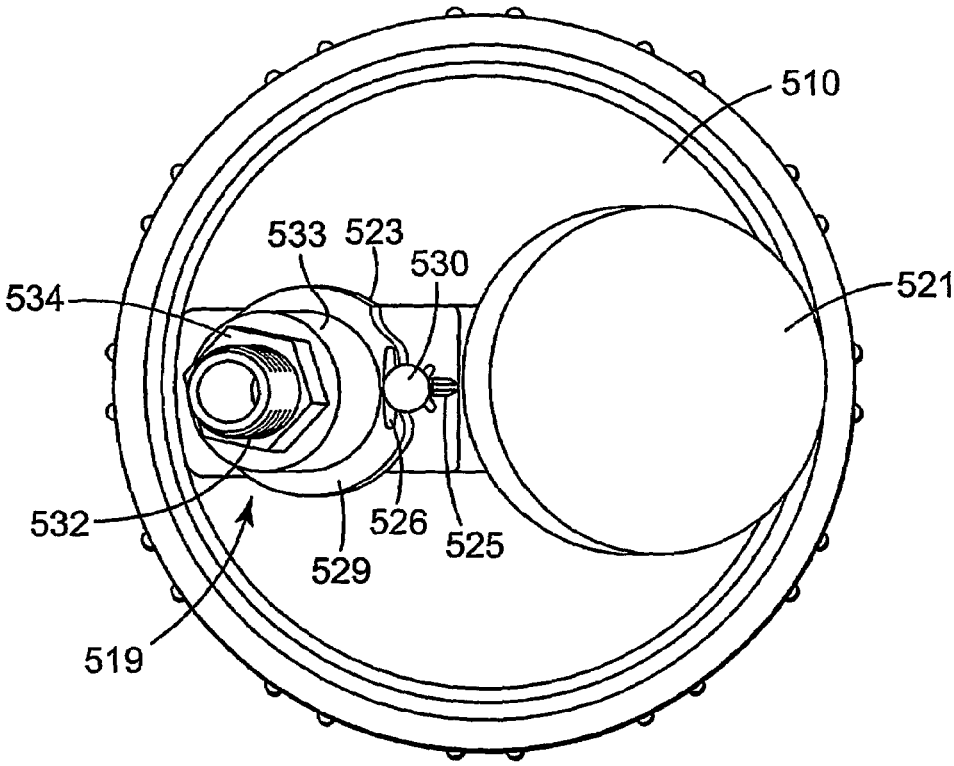
FIG. 13 is a plan view of a fully rotatable connection system for a reservoir employing the prior art adaptor shown in FIGS. 8 and 9 according to a second embodiment of the present invention.
Figure 14:
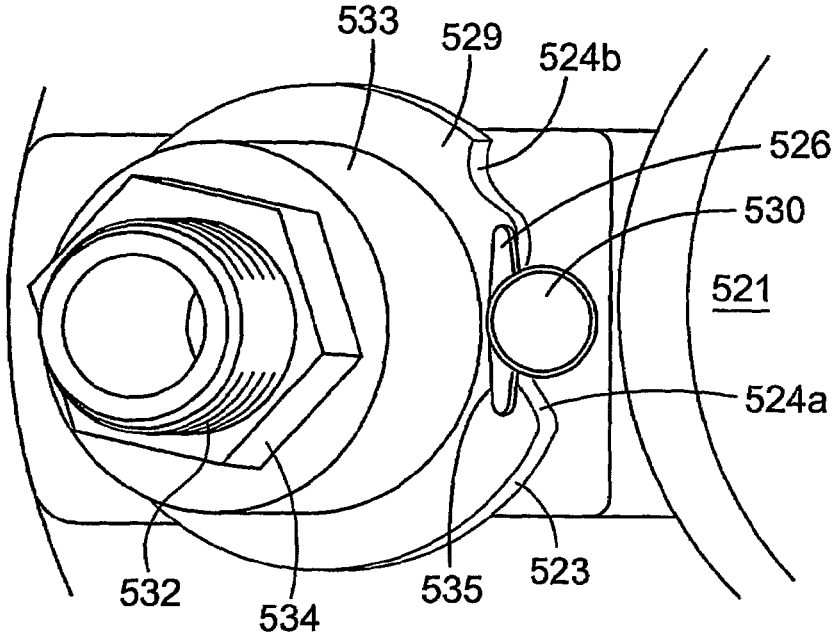
FIG. 14 is a plan view, to an enlarged scale, of the connection system shown in FIG. 13.
Figure 15:
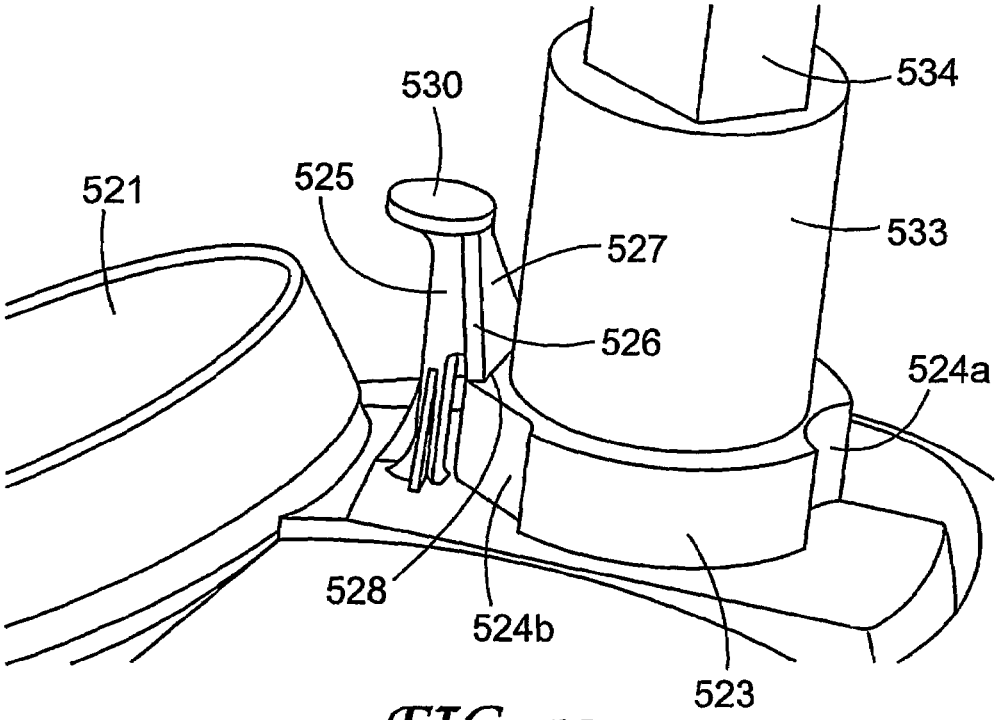
FIG. 15 is a perspective view, to an enlarged scale, from one side of the connection system shown in 13.

Referring now to FIGS. 13 to 15, there is shown a modification to the connector system of FIGS. 10 to 12 employing the prior art adaptor shown in FIGS. 8 and 9. For convenience, like reference numerals in the series 500 are used to corresponding parts.

As shown, the triangular shape of the projection 526 at the distal end of the spring leg 525 is such that the projection 526 can bridge the major recess 524*a* to engage the opposed face 529 of the flange 523 on either side of the recess 524*a*. In this way, engagement of the projection 526 with the flange 523 is maintained if the reservoir 502 is rotated to a position in which the spring leg 525 is opposite the major recess 524*a*. Similarly, engagement is maintained if the reservoir 502 is rotated to align the spring leg 525 with the minor recess 524*b*.

In this way, the reservoir 502 can be connected to a spray gun (not shown) provided with the adaptor 519 of a prior art bayonet connection system and the capability of full rotation of the reservoir 502 through 360° while attached to the spray gun is maintained. As a result, the same adaptor 519 can be used to provide a bayonet connection as shown in FIGS. 8 and 9 or a rotatable latch connection as shown in FIGS. 13 to 15.

Figure 16:
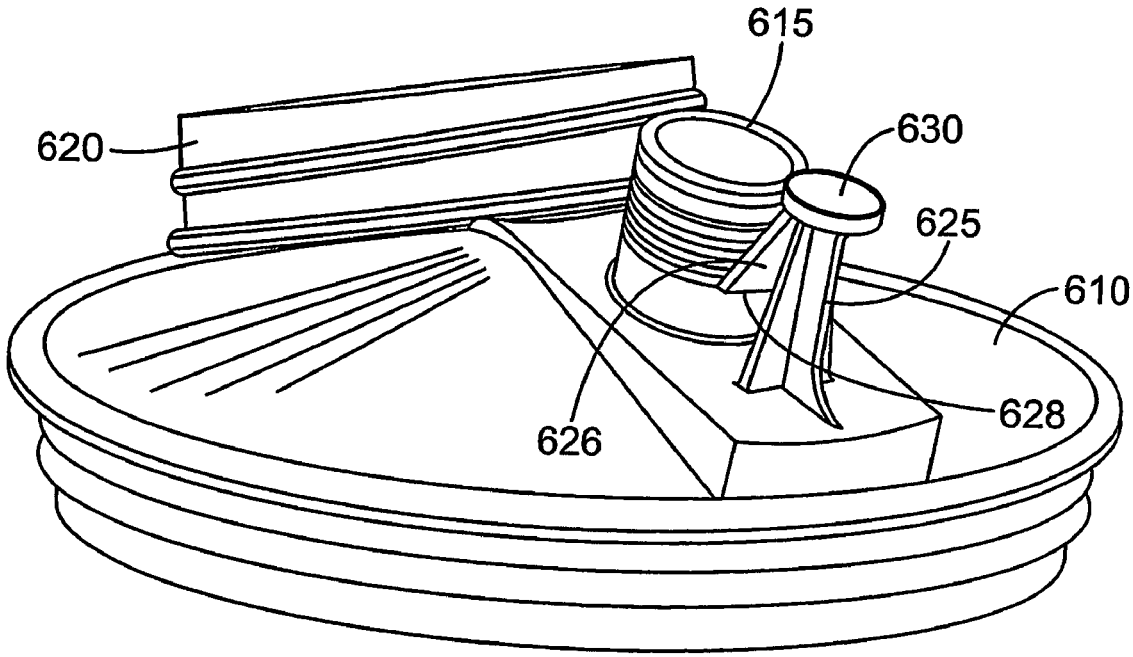
FIG. 16 is a perspective view showing an alternative arrangement of the spring leg shown in FIGS. 10 to 15.

With reference now to FIG. 16, an alternative arrangement of the spring leg of the connector systems of FIGS. 10 to 15 is shown. For convenience, like reference numerals in the series 600 are used to indicate corresponding parts.

As shown, the spring leg 625 is now positioned on the opposite side of the outlet spout 615 adjacent to the outer edge of the lid 610. In this way, access to the annular release button 630 at the distal end of the spring leg 625 may be enhanced when the reservoir (not shown) is connected to a spray gun (not shown). As a result, manual release of the spring leg 625 to allow the reservoir to be detached from the spray gun may be facilitated. It will be understood that the spring leg 625 may be located at any angular position with respect to the spout 615 and that more than one spring leg 625 may be provided at circumferentially spaced positions around the spout 615.

As will now be appreciated, the spring leg and flange provide a self-latching connector system for automatically securing a reservoir to a spray gun and permitting rotation of the reservoir relative to the spray gun while connected to the spray gun. More specifically, the self-latching engagement of the spring leg with the flange resists axial separation of the reservoir from the spray gun while allowing unrestricted rotation of the reservoir through 360° and is manually releasable when the reservoir is to be disconnected from the spray gun.

In this way, the reservoir can be rotated relative to the spray gun without compromising the integrity of the connection between the reservoir and the spray gun. In particular, the fluid tight seal between the reservoir and the spray gun is maintained to prevent liquid leaking out between the spout and socket as the reservoir is rotated. In the above-described embodiments, the seal between the spout and socket also acts to maintain the reservoir in any angularly adjusted position so that unrestricted rotation of the reservoir is prevented as the attitude of the spray gun is adjusted for different spray positions.

Various benefits and advantages of the rotatable connector system above-described will now be described with reference to FIGS. 17 to 22 which show a spray gun and reservoir employing the rotatable connector system of FIGS. 13 to 15. It will be understood that the benefits and advantages also apply to the rotatable connector system of FIGS. 10 to 12 and to the modification of FIG. 16. For convenience, like reference numerals in the series 700 are used to indicate parts corresponding to parts described and illustrated previously.

Figure 17:
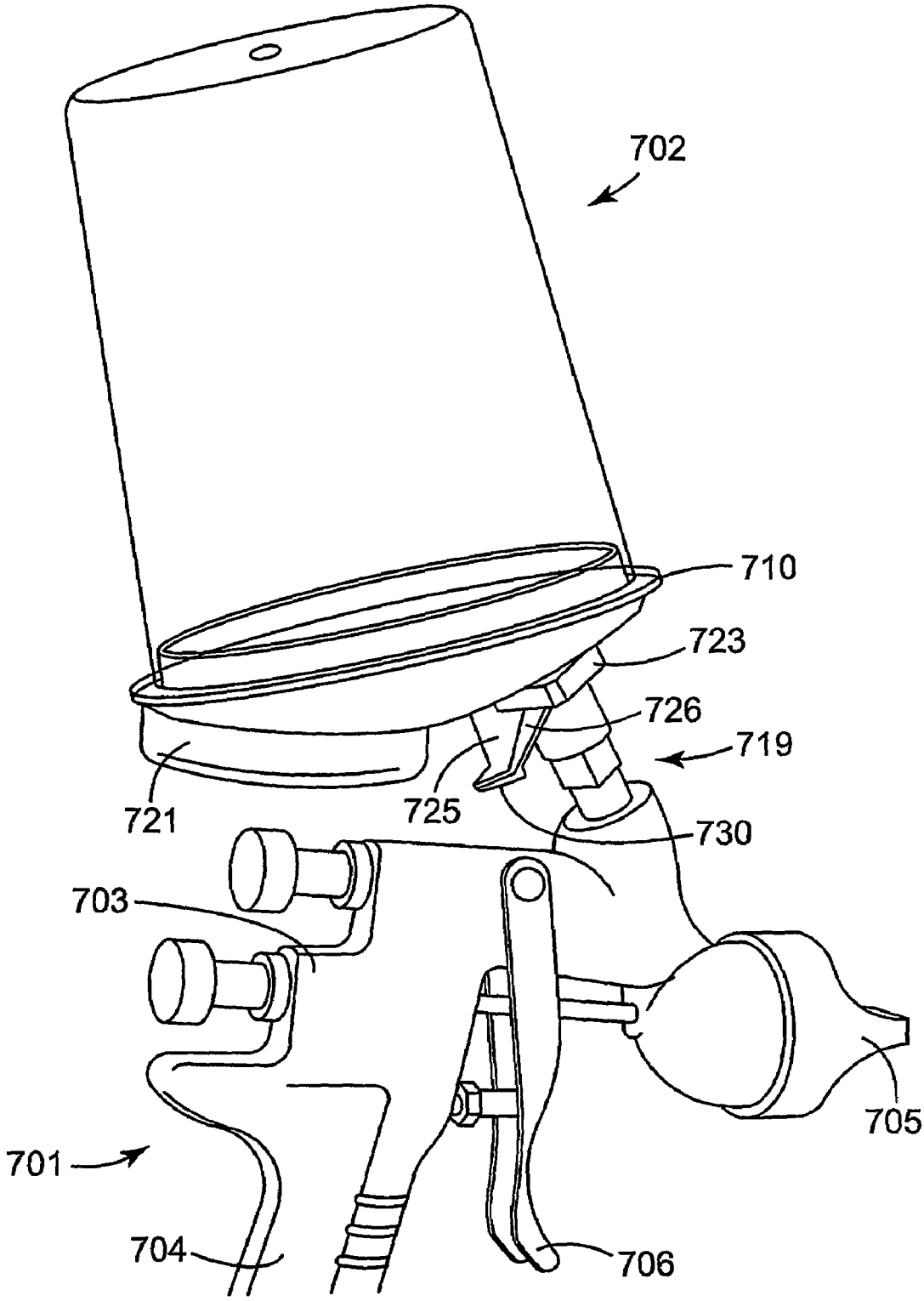
FIG. 17 is a perspective view of a spray gun and reservoir employing the connection system of FIGS. 13 to 15, the spray gun being shown for spraying a vertical panel with the reservoir in a first position.

Referring first to FIG. 17, the spray gun 701 is shown in an upright position with the spray nozzle 705 arranged to provide a horizontal spray such as when spraying a vertical surface. The reservoir 702 is shown secured to the inlet adaptor 719 by the spring leg 725 and the inlet to the reservoir 702 positioned above the body 703 of the spray gun 701.

In this orientation of the spray gun 701 and reservoir 702, the inlet to the reservoir 702 is below the outlet creating a dead space within the reservoir 702. As a result, when spraying, the liquid level in the reservoir 702 may fall below the level of the outlet connection to the spray gun 701. If this occurs, the reservoir 702 can be rotated through 180 degrees to the position shown in FIG. 18 so that the outlet 714 is below the inlet 720 to allow the user to continue spraying without interruption. In this way, substantially all the liquid can be withdrawn from the reservoir 702 without changing the attitude of the spray gun 701 when spraying a vertical surface.

Figure 18:
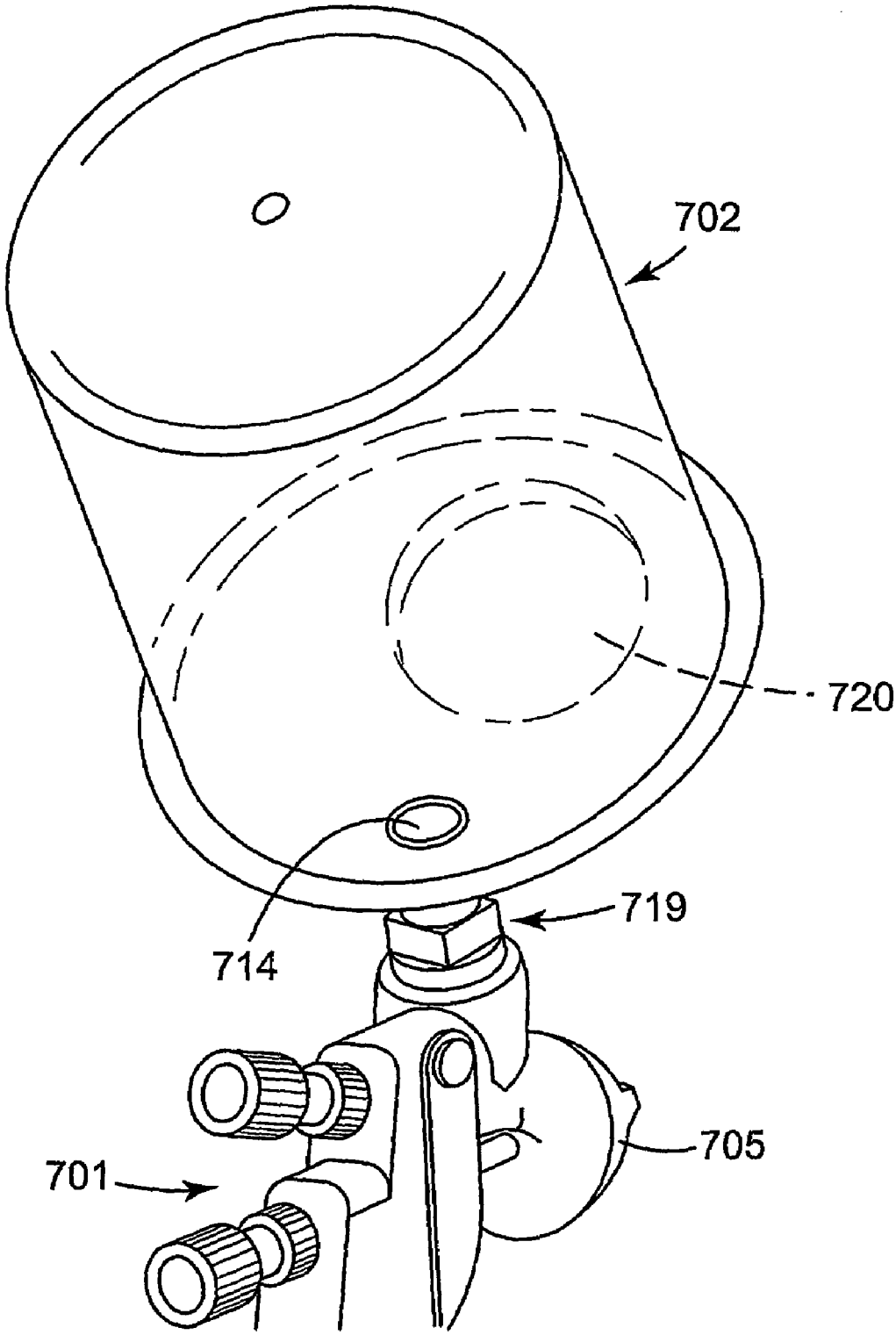
FIG. 18 is a perspective view of the spray gun and reservoir of FIG. 17 with the reservoir in a second position.
Figure 19:
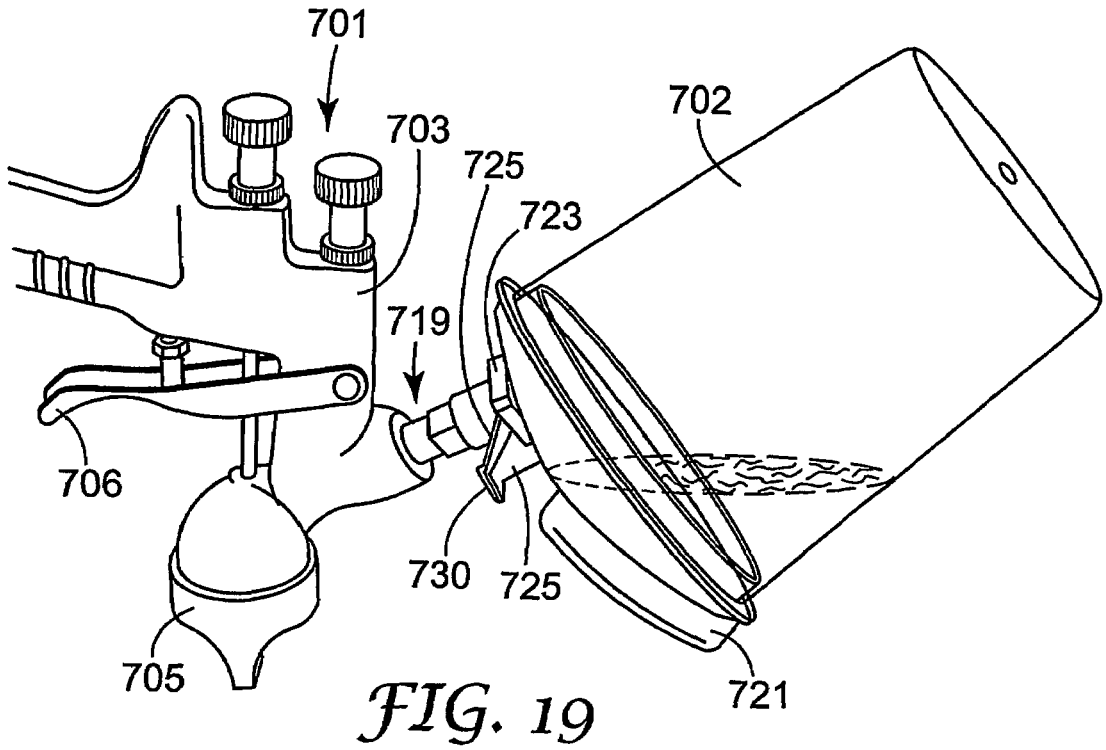
FIG. 19 is a perspective view of the spray gun and reservoir of FIG. 18, the spray gun being shown for spraying a horizontal panel with the reservoir in the second position.
Figure 20:
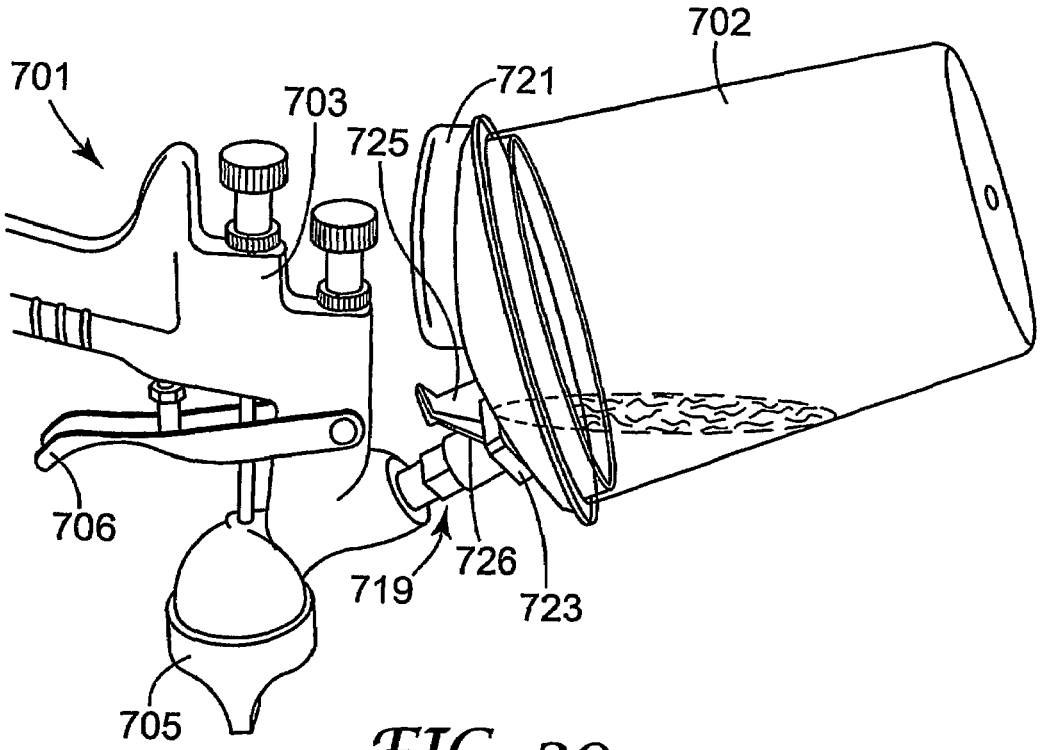
FIG. 20 is a perspective view of the spray gun and reservoir of FIG. 19 with the reservoir in the first position.

Referring now to FIG. 19, the spray gun 701 is shown turned through 90 degrees from the position shown in FIG. 18 to arrange the nozzle 705 to provide a vertical spray such as when spraying a horizontal surface.

In this orientation of the spray gun 701 and reservoir 702, the outlet connection to the spray gun 701 is again above the lowest point of the reservoir creating a dead space within the reservoir 702 in which the liquid level can fall below the outlet as shown. If this happens, the reservoir 702 can be rotated through 180 degrees to the position shown in FIG. 20 so that the outlet connection is at bottom of the reservoir 702 to allow the user to continue spraying without interruption and without changing the attitude of the spray gun 701.

Figure 21:
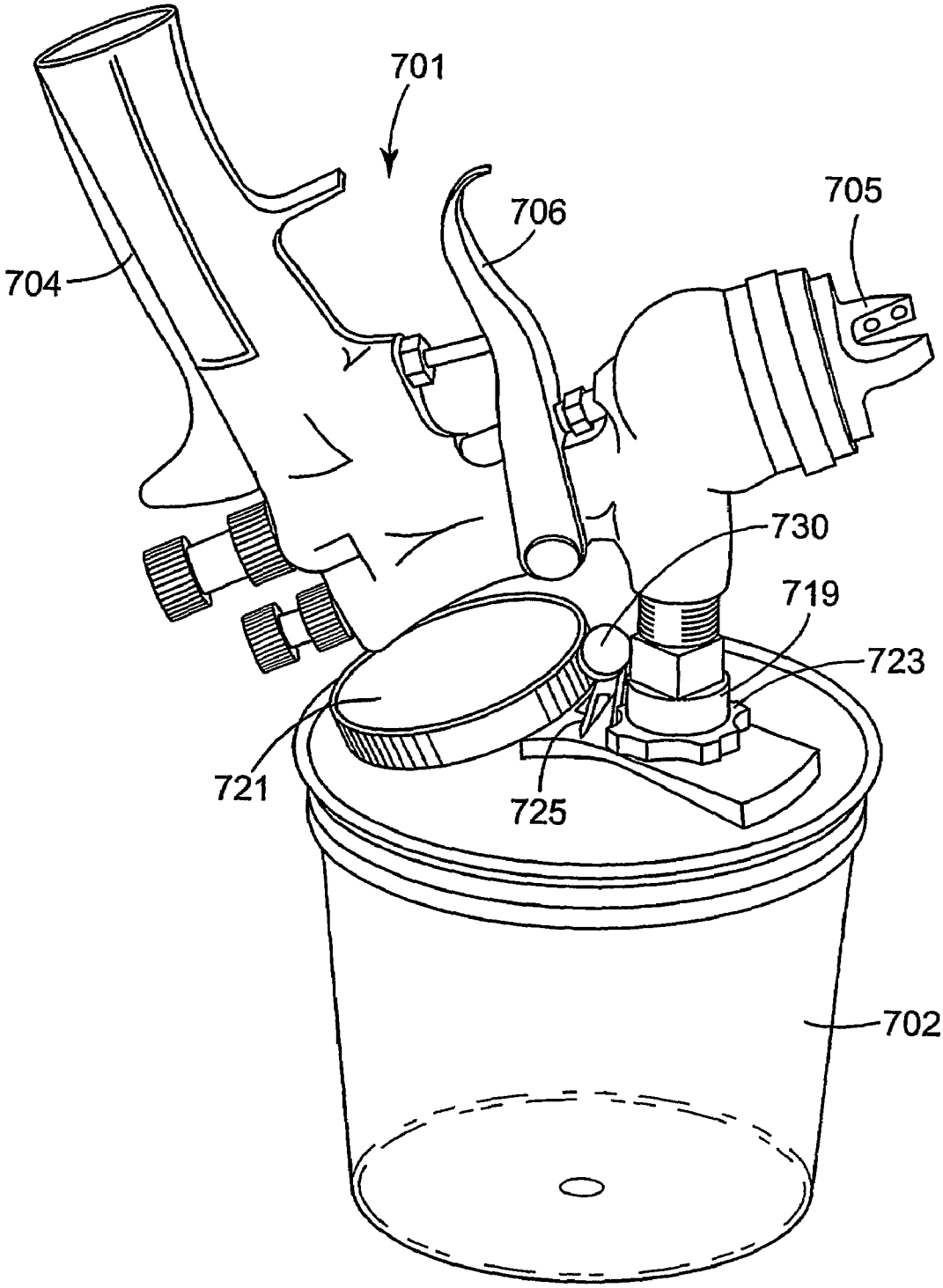
FIG. 21 is a perspective view showing the spray gun and reservoir of FIG. 17 in an inverted position.
Figure 22:
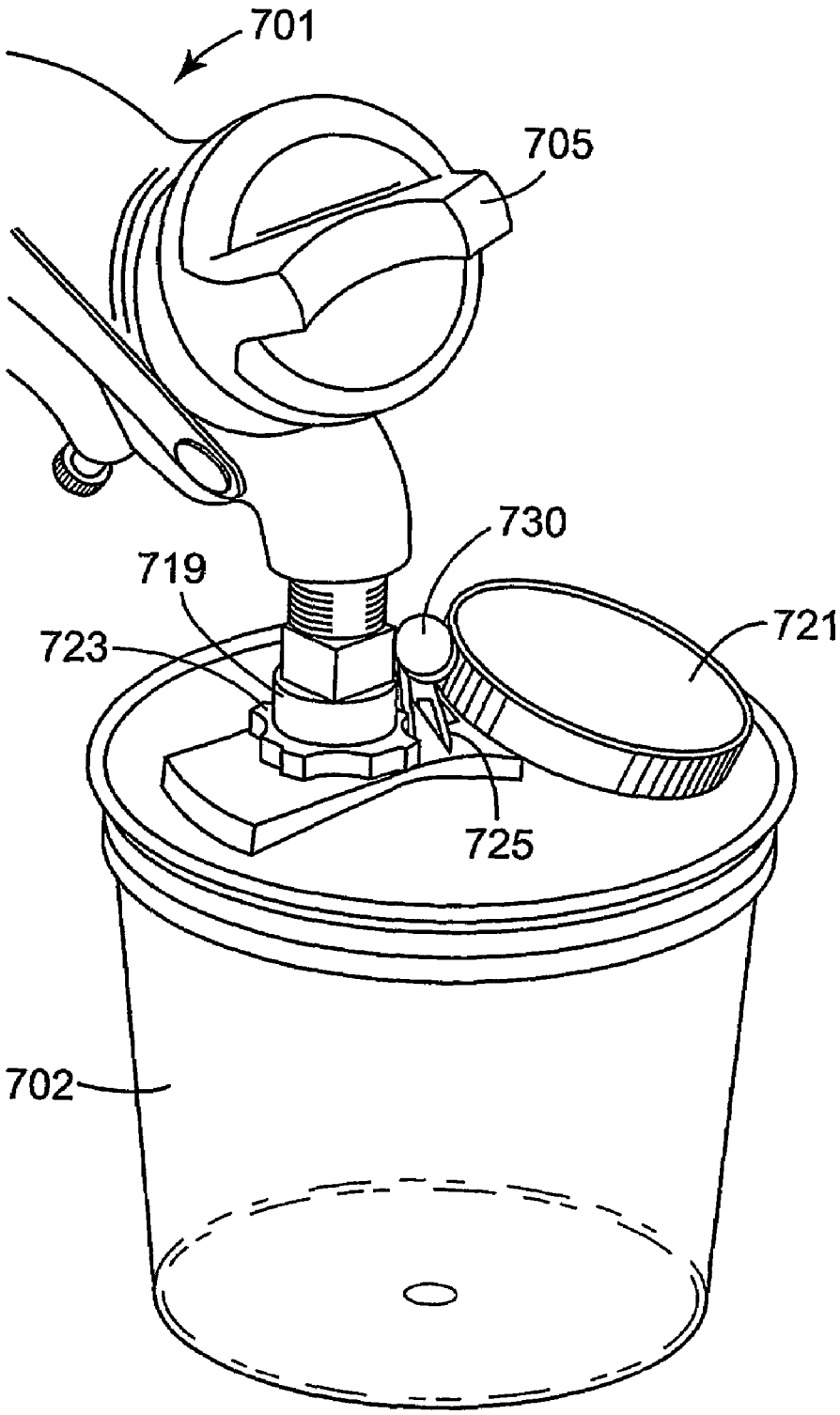
FIG. 22 is a perspective view showing the spray gun and reservoir of FIG. 21 with the reservoir rotated to allow access to the inlet.

Referring now to FIG. 21, the spray gun 701 is shown inverted from the position shown in FIG. 17. The reservoir 702 provides a stable base over which the spray gun 701 can be balanced without disconnecting the spray gun 701 from the reservoir 702. As a result, the user can put the assembly of the spray gun 701 and reservoir 702 down temporarily without risk of spillage or leakage of liquid from the reservoir 702.

In this orientation of the spray gun 701 and reservoir 702, access to the closure cap 721 is restricted. If it is desired to add liquid to the reservoir 702, this can be done while the spray gun 701 is inverted without disconnecting the reservoir 702 by rotating the reservoir 702 to the position shown in FIG. 22. In this position, the reservoir 702 is inclined at a larger angle to the vertical relative to the spray gun 701 and access to the closure cap 721 is facilitated. As a result, the closure cap 721 can be removed and liquid added to the reservoir 702 while attached to the spray gun 701.

As will now be appreciated, rotation of the reservoir relative to the spray gun allows the user to optimise the ergonomics and balance of the assembly when the reservoir is attached to the spray gun. In addition, the occurrence of dead spaces or lost volume within the reservoir can be minimised to enable substantially all the liquid to be withdrawn from the reservoir in any attitude of the spray gun. Furthermore, where provided, access to the inlet opening may be facilitated to allow easier addition of liquid to the reservoir while attached to the spray gun.

It will be appreciated that the exemplary embodiments described herein are intended to illustrate the diverse range and application of the invention and that features of the embodiments may be employed separately or in combination with any other features of the same or different embodiments.

Moreover, while the exemplary embodiments described and illustrated are believed to represent the best means currently known to the applicant, it will be understood that the invention is not limited thereto and that various modifications and improvements can be made within the spirit and scope of the invention as generally described herein.

Thus, the invention has been described with reference to a reservoir in which the outlet spout is offset from the central longitudinal axis of the reservoir. It will be appreciated however, that the invention is not limited to such arrangement and that the connector system can be employed with reservoirs in which the outlet spout is aligned with the central longitudinal axis of the reservoir.

It will also be appreciated that a separate inlet for adding liquid to the reservoir while attached to the spray gun may be provided at any position in the reservoir. Alternatively, the separate inlet may be omitted.

Other modifications and changes will be apparent to those skilled in the art. For example, the arrangement of the spring leg on the lid of the reservoir and the co-operating flange on the inlet adaptor of the spray gun may be reversed so that the spring leg is on the inlet adaptor and the co-operating flange is on the lid. Alternatively, the inlet adaptor may be omitted and the spray gun body provided with one of the spring leg and co-operating flange with the other of the spring leg and co-operating flange being on the lid of the reservoir.

The part provided with the flange may have a locking member that can be moved between an operative position in which it prevents release of the spring leg and an inoperative position in which it permits release of the spring leg. For example, a locking ring slidably and rotatably mounted on the part provided with the flange.

The lateral projection of the spring leg for engaging the flange may be of any suitable shape but is preferably designed to provide a large contact surface area with the flange. In this way, the spring leg effectively resists axial separation of the reservoir and can maintain engagement if the flange has a non-circular profile due to local discontinuities or irregularities.

The outlet spout and associated connector formation may be formed on a lid of the reservoir as described or any other suitable part of the reservoir.

The reservoir may be of any construction for containing paint to be delivered to the spray gun. For example, the reservoir may comprise a disposable lid/liner assembly that can be thrown away after use as described in International Patent Application No. WO 98/32539. The lid and liner may be separate components for assembly with a re-usable outer container and collar. Alternatively, the lid and liner may be permanently secured together in which case the outer container and collar may not be required. In another arrangement, the reservoir may comprise a re-usable paint pot that is cleaned on completion of spraying.

The reservoir may be pre-filled with the paint to be sprayed. Alternatively, the reservoir may be supplied empty and filled by the end user. Pre-filling may be advantageous for spraying paints of standard colours that do not require special matching of the colour, for example primers, base coats etc.

The spray gun may be of the gravity feed type as described in the exemplary embodiments. Alternatively, the spray gun may be of the suction feed type or pressure feed type. The pressure feed type may employ a bleed line from the compressed air supply to the gun to assist delivery of the paint from the reservoir to the spray gun. The invention may also apply to other types and constructions of spray guns for spraying liquids as defined herein.

The invention claimed is:

1. A liquid spraying apparatus comprising a spray gun having an inlet, a reservoir for a liquid to be sprayed, connector means connecting an outlet from the reservoir to the inlet of the spray gun to permit the liquid to be withdrawn from the reservoir in use, the connector means being releasable for detaching the outlet from the inlet, and permitting rotation of the outlet relative to the inlet while the reservoir is attached to the spray gun without compromising the integrity of the connection between the reservoir and the spray gun, wherein the connector means comprises at least one resilient clip on one of the reservoir and spray gun engageable with an abutment on the other of the reservoir and spray gun to resist axial separation of the reservoir and spray gun while permitting rotation of the reservoir outlet relative to the spray gun inlet, wherein the reservoir outlet and spray gun inlet are connectable by push fit and the resilient clip comprises a spring leg arranged to extend substantially parallel to the direction of movement of the reservoir outlet towards/away from the spray gun inlet and the abutment comprises a ledge transverse to said direction of movement such that the spring leg engages behind the ledge when the reservoir outlet is connected to the spray gun inlet and can rotate relative to the ledge while resisting axial separation of the reservoir outlet from the spray gun inlet, and wherein one of the spring leg and ledge has a cam face arranged to deflect the spring leg when the reservoir outlet is connected to the spray gun inlet to allow a distal end of the spring leg to pass the ledge and latch behind the ledge to secure releasably the reservoir to the spray gun.

2. Liquid spraying apparatus according to claim 1 wherein the distal end of the spring leg has an undercut retainer face arranged to latch behind the ledge and the spring leg is manually deflectable to position the retainer face clear of the ledge to release the reservoir and allow the reservoir outlet to be disconnected from the spray gun inlet.

3. Liquid spraying apparatus according to claim 2 wherein the cam face and retainer face are provided by a projection that extends outwards from the distal end of the spring leg towards the ledge.

4. Liquid spraying apparatus according to claim 3 wherein the projection is wider than the spring leg in the direction of rotation of the reservoir.

5. Liquid spraying apparatus according to claim 4 wherein the projection is of generally triangular shape.

6. Liquid spraying apparatus according to claim 5 wherein the distal end of the spring leg is connected to an apex of the triangular projection.

7. Liquid spraying apparatus according to claim 2 wherein the distal end of the spring leg has an actuator for manually releasing the retainer face from the ledge.

8. Liquid spraying apparatus according to claim 1 wherein the spring leg is provided on the spray gun and the ledge on the reservoir.

9. Liquid spraying apparatus according to claim 1 wherein the spring leg is provided in the reservoir and the ledge on the spray gun.

* * * * *